US005164276A

United States Patent [19]

Robinson et al.

[11] Patent Number: 5,164,276

[45] Date of Patent: Nov. 17, 1992

[54] CHARGE GENERATION LAYERS AND CHARGE TRANSPORT, LAYERS FOR ELECTROPHOTOGRAPHIC IMAGING MEMBERS, AND PROCESSES FOR PRODUCING SAME

[75] Inventors: Charles C. Robinson, Fairport; Anita P. Lynch, Webster; Emery G. Tokoli, Rochester; Susan Robinette, Pittsford; Kathleen M. Carmichael, Williamson, all of N.Y.

[73] Assignee: Xerox Corporation, Stamford, Conn.

[21] Appl. No.: 618,731

[22] Filed: Nov. 27, 1990

[51] Int. Cl.[5] ..... G03G 5/06

[52] U.S. Cl. ..... 430/59; 430/83; 430/95

[58] Field of Search ..... 430/58, 59, 83, 95

[56] References Cited

U.S. PATENT DOCUMENTS

| | | | |
|---|---|---|---|
| 4,123,270 | 10/1978 | Heil et al. | 430/138 |
| 4,297,425 | 10/1981 | Pai et al. | 430/58 |
| 4,442,192 | 4/1984 | Pai | 430/59 |
| 4,490,452 | 12/1984 | Champ et al. | 430/58 |
| 4,559,287 | 12/1985 | McAneney et al. | 430/59 |
| 4,711,831 | 12/1987 | Borsenberger | 430/95 |
| 4,755,443 | 7/1988 | Suzuki et al. | 430/59 |
| 4,874,682 | 10/1989 | Scott et al. | 430/59 |
| 4,939,058 | 7/1990 | Shibata et al | 430/59 |

FOREIGN PATENT DOCUMENTS

| | | |
|---|---|---|
| 0114482 | 8/1984 | European Pat. Off. . |
| 0130687 | 1/1985 | European Pat. Off. . |
| 1006609 | 10/1965 | United Kingdom . |

OTHER PUBLICATIONS

IBM Technical Disclosure Bulletin, vol. 24, No. 11B Apr. 1982, p. 6194.

IBM Technical Disclosure Bulletin, vol. 27 No. 10A Mar. 1985, pp. 5597.

IBM Technical Disclosure Bulletin, vol. 27, No. 10A Mar. 2985, p. 5605.

*Primary Examiner*—John Goodrow

*Attorney, Agent, or Firm*—Oliff & Berridge

[57] ABSTRACT

Photoreceptors, charge generation layers and charge transport layers, in which the charge generation layer or charge transport layer includes a dopant of organic molecules containing basic electron donor or proton acceptor groups, and processes for the formation thereof. Preferred dopants include aliphatic and aromatic amines, more preferably, triethanolamine, n-dodecylamine, n-hexadecylamine, tetramethyl guanidine, 3-aminopropyltriethoxy silane, 3-aminopropyltrihydroxysilane and its oligomers.

38 Claims, 2 Drawing Sheets

CHARGE GENERATION LAYERS AND CHARGE TRANSPORT, LAYERS FOR ELECTROPHOTOGRAPHIC IMAGING MEMBERS, AND PROCESSES FOR PRODUCING SAME

BACKGROUND OF THE INVENTION

This invention relates in general to electrophotography, in particular, to charge generation layers and charge transport layers for electrophotographic imaging members, and to processes for preparing the same.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This imaging process may be repeated many times with reusable photoconductive insulating layers.

An electrophotographic imaging member may be provided in any of a number of forms. For example, the imaging member may be a homogeneous layer of a single material such as vitreous selenium or it may be a composite layer containing a photoconductor and another material. One type of composite imaging member comprises a layer of finely divided particles of a photoconductive insulating organic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

More advanced photoconductive receptors contain more highly specialized component layers. For example, one type of multilayered photoreceptor that has been employed in electrophotographic imaging systems is schematically shown in FIG. 1, and comprises a substrate 11, a conductive ground plane 12, a charge blocking layer 13, a charge generation layer 14 (including photogenerating material in a binder), a charge transport layer 15 (including charge transport material in a binder), and an optional overcoating layer 16.

In photoreceptors of the type shown in FIG. 1, the photogenerating material generates electrons and holes when subjected to light. The blocking layer prevents the holes in the conductive ground plane from passing into the generator from which they would be conducted to the photoreceptor surface thus erasing any latent image formed there. The blocking layer, however, permits electrons generated in the generator to pass to the conductive ground plane, thus preventing an undesirably high electric field to build up across the generator upon cycling the photoreceptor.

In electrophotographic imaging systems such as the one schematically shown in FIG. 1, a particularly preferred charge blocking layer is formed of organo silicone compounds. These blocking layer compounds will hereafter be referred to as silane. The presence of a silane blocking layer has, however, been associated with several negative effects on the imaging process. First, it is believed that the silane layer tends to cause a print defect known as reticulation. Reticulation patterns appear in xerographic prints generally because of local areas of uneven thickness in the silane blocking layer, producing differences in the PIDC's in these areas. A PIDC is a measure of the amount of light that produces a given change in the surface voltage for a photoreceptor. Thus, the photoreceptor surface charge density is altered, resulting in a noticeable pattern in the print. These patterns are typically circular in nature. It is believed that reticulation is caused at least in part by a cellular pattern in the silane layer. Second, it is suspected that micro-white spots in printed images may appear when there are pin holes in such a silane blocking layer.

Selenium compositions are particularly preferred photogenerating materials, and such photogenerating materials are improved by doping with sodium. See U.S. Pat. No. 4,232,102 to Horgan et al. In particular, it is believed that sodium-doped selenium pigments provide improved cyclic stability, increased $V_{bg}$, and increased charge acceptance. The background voltage, $V_{bg}$, is the surface potential of the photoreceptor in the areas of the image that are derived from the white portion of the document being copied. High background voltage is undesirable because it indicates that the photoreceptor has lost sensitivity, i.e., it takes more light to generate a given surface voltage drop in forming the latent charge image. However, several defects have been attributed to the use of sodium-doped selenium photogenerating materials. For example, it is suspected that sodium doping of selenium results in an uneven coating of the selenium pigment. It is believed that such uneven coating causes an uneven discharge of the pigment, and may be a source of micro-white spots in printed images.

A second type of multi-layered photoreceptor comprising an inverted structure of several layers of the photoreceptor of FIG. 1 is schematically shown in FIG. 2, and comprises a substrate 21, a conductive ground plane 22, a charge transport layer 23, a charge generation layer 24, and a protective and blocking overcoating layer 25. Typically, layer 25 is an amorphous layer of 2% arsenic and 98% selenium. The top blocking layer is needed in this configuration to prevent holes from the corona charge from entering the charge generation layer and then discharging the negative charge which forms the image on the conductive ground plane.

The assignee of the present application has engaged in development of electrophotographic imaging systems such as the one shown in FIG. 2, and has recognized that such imaging systems occasionally exhibit low charge acceptance and a steep PIDC. A steep PIDC is one wherein a small amount of light produces a large change in surface voltage of a photoreceptor. PIDC sensitivity refers to the ability of a photoreceptor to produce a desired voltage drop with a small or large amount of light. A sensitive PIDC is one that indicates that the photoreceptor exhibits a given voltage drop with a small amount of light. Such systems also occasionally exhibit local areas of low charge acceptance, which lead to print defects described as gray spots. In some instances, the local discharge becomes great enough that the spots become large white areas. In some cases, such spots become worse with cycling.

There is a continuing interest in the development of photoreceptors of the above-described types in which manufacture is simplified, print defects are reduced, particularly over extended use, and useful life is lengthened.

U.S. Pat. No. 4,264,695 to Kozima et al. discloses an electrophotographic element which comprises an electrically conductive support, a first layer comprising a photoconductive substance capable of generating conductive charge carriers through light absorption and an electron donor or an electron acceptor, and a second layer comprising an electron donor or an electron acceptor.

U.S. Pat. No. 4,559,287 to McAneney et al. discloses a photoresponsive imaging member comprising a photogenerating layer and an electron transporting layer, wherein the charge transporting layer includes a stabilizing amount of an aryl amine electron donating compound. The stabilizing material prevents crystallization of the electron transporting layer.

U.S. Pat. No. 4,535,042 to Kitayama et al. discloses an electrophotographic photosensitive member with a layer comprising an electron acceptor and a layer comprising an electron donor, the layers being supported on a conductive substrate. The two layers are superposed upon each other to form a thin layer of charge-transfer complex at the interface between the two layers to utilize the thin layer as a charge generation layer.

U.S. Pat. No. 4,379,823 to Halm discloses a photoconductive coating layer comprising a combination of an organic photoconductive donor compound and an acceptorsensitizer compound. According to the patent, the coating layer may be used for coating a conductive substrate to provide a photoconductive film.

U.S. Pat. No. 4,337,305 to Beretta et al. discloses photoconductive layers formed by sensitizing organic electron donor compounds with dyes. The donor compounds may be combined with polymeric binder materials to form photoconductive layers which are charge transport layers.

U.S. Pat. No. 4,442,192 to Pai discloses a photoresponsive imaging member comprising a conductive substrate, a photoconductive layer containing a photoconductive material dispersed in a resinous binder, a hole trapping layer, and an overcoating layer comprising a composition capable of donating electrons to positive charges contained on the surface of the photoresponsive device.

U.S. Pat. No. 4,576,887 to Ehrlich et al. discloses photoconductive polymer compositions used for the preparation of photodetectors and photoconductive devices. According to the patent, the photoconductivity of the polymer may be enhanced by the addition of an electron-acceptor dopant. The patent notes that the conductivity of some electrically conductive or semiconductive materials can be enhanced through the use of electron acceptor and/or electron donor dopants.

U.S. Pat. No. 4,232,102 to Horgan et al discloses an imaging member comprising a layer of organic resin in which is dispersed a photoconductive material comprising trigonal selenium. This layer can be the charge generation layer in an imaging member also containing a charge transparent layer. The photoconductive material so prepared is useful for improving cyclic charge acceptance and control, and for improving dark decay.

U.S. Pat. No. 4,639,402 to Mishra et al discloses an imaging member comprising an organic resin binder and photoconductive materials containing selenium particles coated with a hydrolyzed aminosilane. This patent discloses only a coating process employing hydrolyzed aminosilane, and does not provide for adding the hydrolyzed aminosilane to the solvent of the coating solution.

SUMMARY OF THE INVENTION

It is an object of the invention to provide processes for preparing layered photoreceptors, and for forming components thereof, which overcome problems in the prior art and which provide improved performance over previous photoreceptors.

In accordance with the present invention, photoreceptors, charge generation layers and charge transport layers are provided in which the charge generation layer or charge transport layer includes a dopant of organic molecules containing basic electron donor or proton acceptor groups, and processes for the formation thereof. Preferred dopants include triethanolamine, n-dodecylamine, n-hexadecylamine, tetramethyl guanidine, 3-aminopropyltriethoxy silane, 3-aminopropyltrihydroxysilane and its oligomers, and mixtures and combinations thereof.

BRIEF DESCRIPTION OF THE DRAWINGS

The present invention may be more fully understood with reference to the accompanying drawings and the following description of the embodiments shown in the drawings. The invention is not limited to the exemplary embodiments and should be recognized as contemplating all modifications within the skill of an ordinary artisan.

DETAILED DESCRIPTION OF PREFERRED EMBODIMENTS

Figure 1:
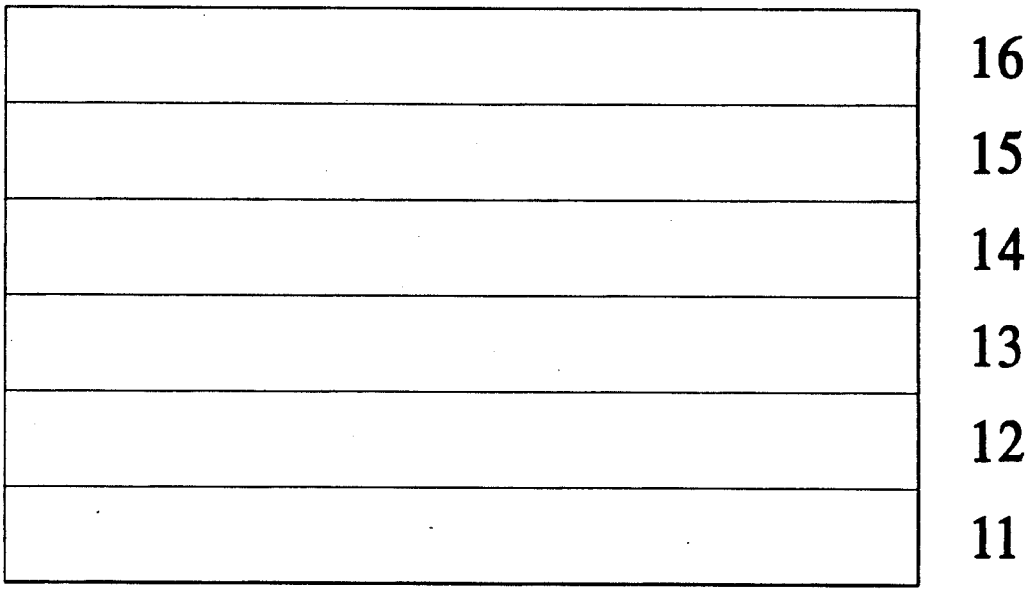
FIGS. 1 and 2 are schematic drawings of photoreceptors.

Photoreceptors in accordance with the present invention generally comprise a conductive layer, a charge generation layer and a charge transport layer. In some embodiments, the charge generation layer is between the conductive layer and the charge transport layer, and in other embodiments according to the present invention, the charge transport layer is between the conductive layer and the charge generation layer.

The present invention is directed to photoreceptors in which either the charge generation layer or the charge transport layer is doped (either both layers simultaneously or either one individually) with organic molecules containing basic electron donor or proton acceptor groups, e.g., basic nitrogen compounds, particularly those that are non-cyclic, cyclic, or heterocyclic. Aliphatic and/or aromatic amines are preferred dopants. In addition, oxygen, sulfur and phosphorus containing bases can be suitable as dopants. Especially preferred dopants in accordance with the present invention include triethanolamine (TEA), n-dodecylamine (DA), n-hexadecylamine (HA), tetramethyl guanidine (TMG), 3-aminopropyltriethoxy silane, 3-aminopropyltrihydroxysilane and its oligomers and mixtures and combinations thereof.

In particular, it is more preferable to dope the charge generation layer in accordance with the present invention, rather than doping the charge transport layer, since doping the charge generation layer provides better electrical stability when humidity is increased. In general, however, due to chemical interdiffusion between the charge transport layer and the charge generation layer, doping in either layer or both layers can produce similar effects.

Optimum amounts of dopant in accordance with the present invention depend upon the materials that are used to formulate the photoreceptor. Invariably, some of the starting materials in different lots may be more acidic or basic depending upon variations in the process of their manufacture. The amount of dopant will depend upon this characteristic of the materials. Some materials produce faster photoreceptors, while others produce slower photoreceptors, and changes in the amount of dopant would accommodate for such variations.

Preferred amounts of dopant also depend on the process of formulating the photoreceptor, and the materials used in formulating the photoreceptor.

Photoreceptors according to the present invention may comprise a substrate which is electrically conductive or electrically non-conductive, which substrate may be coated with an electrically conductive ground plane. When a non-conductive substrate is employed, an electrically conductive ground plane must be employed, and the ground plane acts as the conductive layer. When a conductive substrate is employed, the substrate may act as the conductive layer, although a conductive ground plane may optionally also be provided.

Photoreceptors according to the present invention may further comprise a charge blocking layer. However, an important advantage in accordance with the present invention is that the need for a blocking layer is generally eliminated. If a blocking layer is nevertheless employed, it is preferably positioned over the conductive layer. The term "over", as used in many instances herein in connection with many different types of layers, should be understood as being not limited to instances wherein layers are contiguous.

Photoreceptors in accordance with the present invention further include a charge transport layer and a charge generation layer, both of which are positioned over the conductive layer and over any blocking layer. As discussed above, in some embodiments in accordance with the present invention, the charge generation layer is positioned between the conductive layer and the charge transport layer, and in other embodiments, the charge transport layer is positioned between the conductive layer and the charge generation layer.

Figure 2:
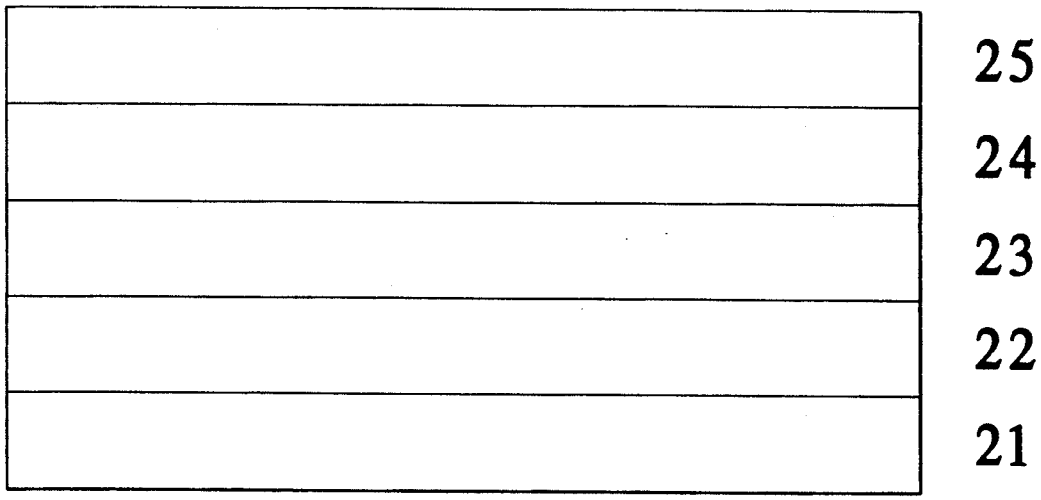

Embodiments in accordance with the present invention may further comprise an overcoating layer or layers, which, if employed, is positioned over the charge generation layer as in FIG. 2 or over the charge transport layer, as in FIG. 1.

Furthermore, adhesive layers may be provided between any layers, or as part of one or more layer, to provide suitable adhesion between such layers. In the examples cited herein, the adhesive layer is located between the blocking layer and the generator layer.

The present invention also provides a charge generation layer comprised of film forming binder, photogenerating material and at least one dopant selected from the group of dopants set forth above. The present invention further provides a charge transport layer comprised of film forming binder, charge transport molecules and at least one dopant selected from the group of dopants set forth above.

The present invention also provides processes for preparing photoreceptors, comprising applying over a conductive layer a charge generation layer and a charge transport layer, the charge generation layer and charge transport layer being applied in either order. Either the charge generation layer or the charge transport layer (or both) comprises a dopant selected from the group of dopants listed above. The charge generation layer is preferably applied by applying a charge generation coating composition comprising charge generation film-forming binder, solvent for the charge generation film-forming binder and photogenerating particles, optionally together with at least one dopant. The charge transport layer is preferably applied by applying a charge transport coating composition comprising charge transport film-forming binder, solvent for the charge transport film-forming binder and charge transport molecules, optionally together with dopant.

Photoreceptors according to the present invention achieve (1) a decrease in the growth of some print defects, e.g., micro-white spots or gray spots, particularly with increased electrical cycling; (2) an increase in charge acceptance; (3) a decrease in PIDC sensitivity; (4) a reduction in the decline of $V_{ddp}$ with cycling (i.e., cycle down) under constant current charging; (5) an increased barrier to hole injection from the metal ground plane to the remainder of the photoreceptor; and/or (6) a reduction in the growth of the electronic depletion layer in the bottom part of the charge generation layer. The electronic depletion layer occurs in a photoreceptor because of the presence of impurities or because of electrical cycling. The electron depletion layer is formed when the electron charge is fixed. The charge compensating holes that are present in the absence of an electric field are in a more or less free state. Upon charging and thereby producing an electric field across the depletion region, the holes leave and the electron are left behind forming the electron depletion layer.

A rest significantly longer than the time between cycles causes the holes to reform around the electrons. Thus upon recharging after such a rest, a significantly lower charge acceptance is observed. The time between continuous cycles may not allow a significant number of holes to reform and therefore the loss in charge acceptance may not be as great between continuous cycles. The presence of a depletion layer increases the instability of the photoreceptor and its elimination is desirable.

Increased charge acceptance provides decreased electrical stresses on the photoreceptor, and for a given $V_{ddp}$, less charge is required, thus, the photoreceptor can operate at a lower electric field during its cycling life. Under such a lower field, detrimental growth of photoreceptor related print defects, such as reticulation or micro-white spots, is less likely to occur. Increased charge acceptance thus provides decreased growth of some print defects as a function of cycling, increases the photoreceptor life, and may do away with a need for charging controls.

A decrease in PIDC sensitivity, i.e., a slowed down PIDC of charge generating pigment (a slower photoresponse), provides higher $V_{bg}$, background voltage, and $V_r$, residual voltage. It may be desirable, because of fluctuations in batches of materials, to reduce the sensitivity of photoreceptor's fabricated from these batches in order to meet the photoreceptor PIDC specifications.

Decreased PIDC sensitivity also provides increased charge acceptance and increased cycle stability.

A reduction in the decline of $V_{ddp}$ with cycling (i.e., cycle down) under constant current charging increases cyclic stability, which reduces growth of print defects.

An increased barrier to hole injection from the metal ground plane to the remainder of the photoreceptor counteracts local high hole injection from the ground plane, and helps to reduce the growth of print defects, e.g., by reducing the number of micro-white spots.

Reducing the growth of the electronic depletion layer in the bottom part of the charge generation layer decreases the cycle down.

It is also believed that micro-white spots can arise from local regions of acidity in the photoreceptor. Doping in accordance with the present invention neutralizes such regions, thereby reducing the formation of micro-white spots.

The provision of dopant in accordance with the present invention can eliminate the need for sodium doping of selenium pigment in the charge generation layer, thereby providing numerous advantages. The doping in accordance with the present invention provides a more homogeneous doping process of evenly doping the entire coating solution with a well dispersed molecular dopant, instead of doping (in an inhomogeneous manner) discrete selenium particles with sodium. As a result, the present invention provides more uniform discharge of the photogenerating pigment. Since the dopant in accordance with the present invention results in a decrease in the number of micro-white spots, up to levels comparable to that obtained using sodium-doped selenium, there is no loss in performance in regard to the formation of micro-white spots by eliminating sodium doping in favor of the doping of the present invention. Furthermore, the substitution of the dopant of the present invention for sodium doping does not decrease the sensitivity of the photoreceptor.

By eliminating sodium doping, the photoreceptor is made faster with increased cycle down. The back doping of amines can thus be greater, so as to correct some of the non-pigment related sources of micro-white spots. It is preferable to eliminate the sodium doping when using the dopant according to the present invention, since otherwise, the amount of dopant added could not be as great because the photoreceptor would become unacceptably slow. If sufficient dopant according to the present invention is added, the charge acceptance increases and the fatigued dark decay decreases. Thus, to obtain a given initial $V_{ddp}$, less charge is required, and therefore, the electric field across the photoreceptor is less, leading to a decrease in the growth of photoreceptor related defects such as reticulation and micro-white spots.

Simultaneous elimination of both the silane blocking layer and the sodium doping of selenium pigment makes it possible to employ even higher levels of dopant according to the present invention, thereby allowing further reduction in micro-white spots.

Doping with triethanolamine, or similar and related compounds, which contain hydroxyl groups, significantly increases the unfavorable effects on electrical properties with increase in humidity. Specifically, residual voltages are greater at high humidity for triethanolamine doping in accordance with the present invention than for dopants in accordance with the present invention which are less sensitive to humidity, e.g., TMG, DA and HA. It has been observed with 3-aminopropyl triethoxysilane dopant that the presence of the silicic acid groups counteracts the basic effect of the amine. As a result, larger molecular densities of this molecule in the photoreceptor are required to provide the desired electrical effects.

Furthermore, the present inventors have recognized that variations in the materials used to make a photoreceptor at times produces a combination of materials which results in a photoreceptor which is too fast and which cycles down too much. The use of the doping technique in accordance with the present invention can rectify such deficiencies, i.e., can increase the $V_{bg}$ of a materials package which produces a photoreceptor which is too sensitive.

The present inventors have observed that charge generation coating compositions including a given amount of TMG dopant applied by machine produce a photoreceptor which provides higher $V_{bg}$ than if the charge generation layer were applied by hand. It is expected that the different fabrication techniques may require different levels of doping to obtain the desired effects.

Figure 3:
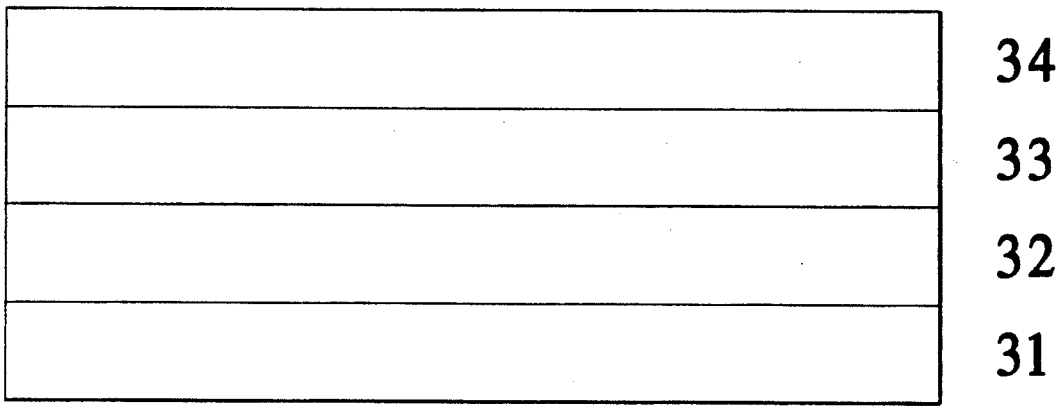
FIGS. 3 and 4 are schematic drawings of photoreceptors according to the present invention.

FIG. 3 illustrates one embodiment of a photoreceptor in accordance with the present invention. The photoreceptor of FIG. 3 includes a substrate 31, a conductive ground plane 32, a charge generation layer 33 and a charge transport layer 34.

Figure 4:
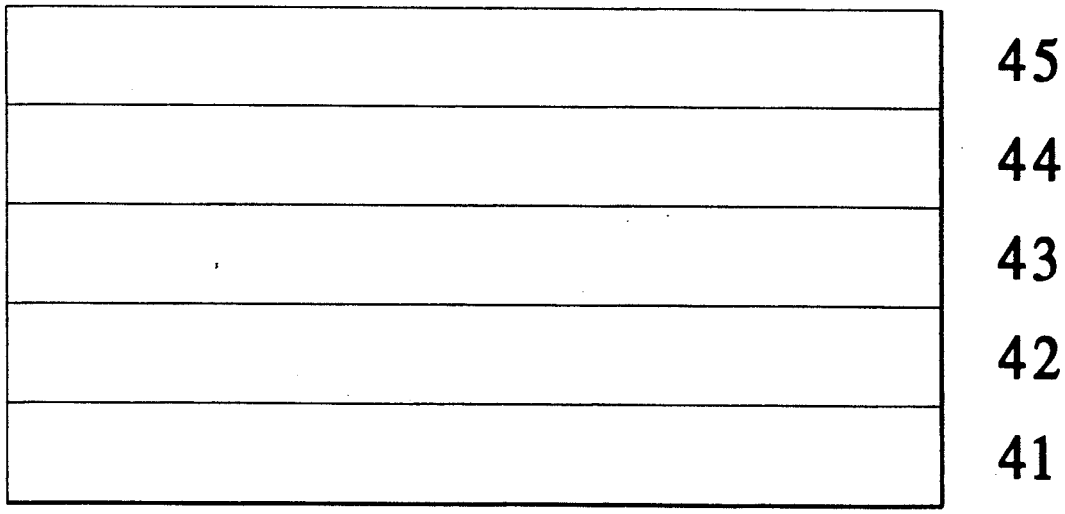

FIG. 4 illustrates a second embodiment of a photoreceptor in accordance with the present invention. The embodiment shown in FIG. 4 includes a substrate 41, a conductive ground plane 42, a charge transport layer 43, a charge generation layer 44, and a protective and blocking overcoating layer 45.

The following is a description of layers, and the formation thereof, which may be employed in photoreceptors in accordance with the present invention. Other arrangements may also be used.

The photoreceptors in accordance with the present invention are preferably prepared by first providing a substrate. The substrate may be opaque or substantially transparent and may comprise any of numerous suitable materials having the required mechanical properties. The substrate may comprise a layer of electrically non-conductive material or a layer of electrically conductive material such as an inorganic or organic composition. If a non-conductive material is employed, it is necessary to provide an electrically conductive ground plane over such non-conductive material. If a conductive material is used as the substrate, a separate ground plane layer may not be necessary.

The substrate is preferably flexible and may have any of a number of different configurations such as, for example, a sheet, a scroll, an endless flexible belt, and the like. Preferably, the substrate is in the form of an endless flexible belt. The photoreceptor in this invention can also be coated on a rigid opaque conducting substrate such as an aluminum drum. In that case, the photoreceptor would be erased from the front.

As electrically non-conducting materials, there may be employed various resins known for this purpose, including polyesters, polycarbonates, polyamides, polyurethanes, and the like. The substrate preferably comprises a commercially available biaxially oriented polyester known as Mylar, available from E.I. du Pont de Nemours & Co., Melinex, available from ICI Americas Inc. or Hostaphan, available from American Hoechst Corporation. Other materials which the substrate may comprise include polymeric materials such as polyvinyl fluoride, available as Tedlar from E.I. du Pont de Nemours & Co., and polyimides, available as Kapton from E.I. du Pont de Nemours & Co. The photoreceptor can also be coated on an insulating plastic drum providing that a conducting groundplane was coated on its surface.

When a conductive substrate is employed, any suitable conductive material may be used. For example, the conductive material may include metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or their pyrolysis and molecular doped products, charge transfer complexes, polyphenylsilane and molecular doped products from polyphenylsilane. A conducting metal drum made from a material such as aluminum can be used, as well as a conducting plastic drum.

The preferred thickness of the substrate depends on numerous factors, including mechanical performance required and economic considerations. The thickness of the substrate is typically within the range of from about 65 micrometers to about 150 micrometers, preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example, less than 50 micrometers, provided there are no adverse effects on the final photoconductive device. If an aluminum drum is used, the thickness must be sufficient to provide the necessary rigidity.

The surface of the substrate to which a layer is to be applied is preferably cleaned to promote greater adhesion of such a layer. Cleaning may be effected by exposing the surface of the substrate layer to plasma discharge, ion bombardment and the like. Other methods such as solvent cleaning may be used.

The electrically conductive ground plane, if employed, is positioned over the substrate. Suitable materials for the electrically conductive ground plane include aluminum, zirconium, niobium, tantalum, vanadium, hafnium, titanium, nickel, stainless steel, chromium, tungsten, molybdenum, copper and the like, and mixtures and alloys thereof, with aluminum, titanium and zirconium being preferred.

The ground plane may be applied by known coating techniques, such as solution coating, vapor depositing and sputtering. A preferred method of applying an electrically conductive ground plane is by vacuum deposition. Other suitable methods may also be used.

Preferred thicknesses of the ground plane are within a substantially wide range, depending on the optical transparency and flexibility desired for the electrophotoconductive member. Accordingly, for a flexible photoresponsive imaging device, the thickness of the conductive layer is preferably between about 20 Angstroms and about 750 Angstroms, more preferably from about 50 Angstroms to about 200 Angstroms, for an optimum combination of electrical conductivity, flexibility and light transmission. However, the ground plane can be opaque and front erase employed.

As discussed above, a blocking layer may be positioned over the conductive layer. In some devices, such as the one shown in FIG. 3, doping the charge generation layer in accordance with the present invention increases the hole injection barrier at the interface between the conductive ground plane and the charge generation layer to such an extent that the blocking layer, typically formed of silane, is no longer needed. The elimination of the blocking layer has several advantages. First, this results in a reduction of the number of coating steps. Second, in the case of a silane blocking layer, the elimination of the blocking layer avoids the phenomenon of reticulation and reduces the formation of micro-white spots associated with a silane blocking layer. Furthermore, doping in accordance with the present invention and elimination of the silane blocking layer results in a decrease in the PIDC sensitivity. The elimination of the silane layer and the use of the doping method may result in a decrease in PIDC sensitivity over that which would occur if the silane layer was present, depending on the materials and the fabrication techniques. (The desired improvement resulting from doping must always be weighed against the possible reduction in PIDC sensitivity.)

Nevertheless, if desired, a charge blocking layer may be employed in the present invention and may be applied over the conductive layer. For the inverted photoreceptor structure of FIG. 2, the hole blocking layer 25 prevents holes from the charging surface from migrating through the photoreceptor to the ground plane, thus destroying the latent image. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like. The hole blocking layer may also comprise nitrogen-containing siloxanes or nitrogen-containing titanium compounds such as trimethoxysilyl propylene diamine, hydrolyzed trimethoxysilyl propyl ethylene diamine, N-beta(aminoethyl) gamma-aminopropyl trimethoxy silane, isopropyl 4-amino-benzene sulfonyl, di(dodecylbenzene sulfonyl) titanate, isopropyl di(4-aminobenzoyl)isostearoyl titanate, isopropyl di(4-amino-benzoyl)isostearoyl titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxy-silane, and $[H_2N(CH_2)_3]CH_3Si)(OCH_3)_2$ and (gamma-aminopropyl) methyl diethoxysilane, as disclosed in U.S. Pat. Nos. 4,338,387, 4,286,033 and 4,291,110. Other suitable materials may be used. A preferred hole blocking layer comprises a reaction product between a hydrolyzed silane or mixture of hydrolyzed silanes and the oxidized surface of a metal ground plane layer. The oxidized surface inherently forms on the outer surface of most metal ground layers when exposed to air after deposition. This combination enhances electrical stability at low relative humidity. The hydrolyzed silanes have the general formula

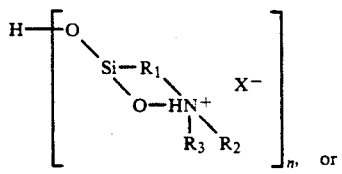

I or

-continued

II

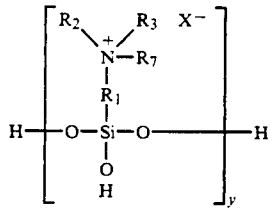

wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4. Other suitable materials may be used.

While the blocking layer is not necessary for the present invention in view of the fact that doping has the same advantageous effect in the presence or absence of the silane blocking layer, in some embodiments it may be present. In these embodiments, the blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness of between about 0.03 micrometer and about 0.06 micrometer is preferred for optimum electrical behavior. The blocking layer may be applied by any suitable conventional technique such as by spraying, dip coating, wire wound rod coating, draw bar coating, gravure coating, silk screening, air knife coating, roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of blocking layer material to solvent between about 0.05:100 and about 0.5:100 is satisfactory for spray coating. The ratio of solvent to the coating solids is variable, depending upon the coating method.

The charge generation layer in accordance with the present invention comprises charge generation film forming polymer and photogenerating particles. The charge generation layer of some embodiments in accordance with the present invention further comprises one or more dopant comprising organic molecules containing basic electron donor or proton acceptor groups.

Suitable charge generation film forming polymers include those described, for example, in U.S. Pat. No. 3,121,006. The film forming polymer preferably adheres well to the layer on which the charge generation layer is applied, preferably dissolves in a solvent which also dissolves any adjacent adhesive layer (if one is employed) and preferably is miscible with the copolyester of any adjacent adhesive layer (if one is employed) to form a polymer blend zone. For example, suitable film forming materials include polyvinylcarbazole (PVK), phenoxy resin, polystyrene, polycarbonate resin, such as those available under the tradenames Vitel PE-100 (available from Goodyear) and Lexan 141 and Lexan 145 (available from General Electric). Other suitable materials may be used.

Examples of materials which are suitable for use as photogenerating particles include, for example, particles comprising amides of perylene and perinone, chalcogens of selenium II-VI or tellurium III-V compounds, amorphous selenium, trigonal selenium, and selenium alloys such as, for example, selenium-tellurium, selenium-telluriumarsenic, selenium arsenide, and phthalocyanine pigments such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from E.I. du Pont de Nemours & Co. under the tradename Monastral Red, Monastral Violet and Monastral Red Y, dibromo anthanthrone pigments such as those available under the tradenames Vat orange 1 and Vat orange 3, benzimidazole perylene, substituted 2,4-diamino-triazines disclosed in U.S. Pat. No. 3,442,781, polynuclear aromatic quinones available from Allied Chemical Corporation under the tradenames Indofast Double Scarlet, Indofast Violet Lake B, Indofast Brilliant Scarlet and Indofast Orange, and the like. Particularly preferred photogenerating particles include particles comprising vanadyl phthalocyanine, trigonal selenium, and benzimidazole perylene.

Multi-photogenerating layer compositions may be utilized where a photoconductive layer enhances or reduces the properties of the photogeneration layer. Examples of this type of configuration are described in U.S. Pat. No. 4,415,639. Other suitable photogeneration materials known in the art may also be utilized, if desired. Charge generation layers comprising a photoconductive material such as vanadyl phthalocyanine, titanyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, titanyl phthalocyanine, metal free phthalocyanine and tellurium alloys are also preferred because these materials provide the additional benefit of being sensitive to infra-red. The preferred photoconductive materials for use in the charge generation layers are benzimidazole perylene, trigonal selenium and vanadyl phthalocyanine.

The photogeneration layer in some embodiments in accordance with the present invention is applied over the conductive layer (or any charge blocking layer over the substrate) and the charge transport layer is applied over the photogeneration layer. In other embodiments in accordance with the present invention, the charge generation layer is applied over the charge transport layer.

The charge generation layer is preferably applied by forming a charge generation coating composition by providing charge generation film forming binder in a suitable solvent, and then adding photogenerating particles. Other methods such as mixing binder, photogenerating particles and solvents together initially are not excluded. For embodiments in which the charge generation layer includes one or more dopant, the dopant is preferably added to the solvent and then to the film forming binder and the photogenerating particles.

Suitable solvents for use in charge generation coating compositions according to this invention include tetrahydrofuran, cyclohexanone, methylene chloride, 1,1,1-trichloroethane, 1,1,2-trichloroethane, trichloroethylene, toluene, and the like, and mixtures thereof. Other suitable solvents may be used. Mixtures of solvents may be utilized to control evaporation range. For example, satisfactory results may be achieved with a tetrahydrofuran to toluene ratio of between about 90:10 and about 10:90 by weight.

Generally, the combination of photogenerating pigment, binder polymer and solvent should form uniform dispersions of the photogenerating pigment in the charge generation coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride. The solvent for the charge generation film forming binder should dissolve the binder utilized in the charge generation layer and be capable of dispersing the photogenerating pigment particles used in the charge generation layer. When a dopant is provided in the charge generation coating composition, it should likewise dissolve in the solvent.

The concentration of photogenerating particles in the charge generation coating composition is generally within the range of from about 5 to about 90 vol. %, preferably from about 7.5 to about 30 vol. %, more preferably from about 7.5 to about 20 vol. %. The concentration of film forming binder in the charge generation coating composition is generally from about 95 to about 10 vol. %, preferably from about 92.5 to about 70 vol. %, more preferably from about 92.5 to about 80 vol. %. The concentration of solvent in the charge generation coating composition is generally from about 2 to about 50 vol. %, preferably from about 3 to about 20 vol. %, more preferably from about 3 to about 10 vol. %.

When dopant is included in the charge generation coating composition, the concentration of dopant is generally in the range of from about 0 to about 1000 ppm by weight, based on the weight of solvent, preferably from about 0 to about 50 ppm by weight, based on the weight of solvent, more preferably from about 0 to about 25 ppm by weight, based on the weight of solvent.

An example would be the addition of the above prescribed amounts of dopant by volume to the THF-toluene solvent in the following generator coating solution:

Solids 7.5 vol. % trigonal selenium
25 vol. % mTBD
67.5 vol. % PVK

Solvent 50 vol. % THF
50 vol. % toluene

Mix to form a solution of 6 vol. % solids.

This example applies to coatings made on a Bird bar coater. For a machine coated generator, the solids would be increased to 8 vol. % and for a spray coated generator, the solids would be decreased to 0.5 to 5 vol. %. It would be necessary to adjust the dopant concentration in the solvent to allow for the difference in the ratio of pigment to solvent.

The charge generation coating composition is applied by any suitable technique, for example, by hand, spraying, dip coating, draw bar coating, gravure coating, silk screening, air knife coating, vacuum deposition, chemical treatment, roll coating, wire wound rod coating, and the like. The charge generation coating composition is then dried to remove the solvent. Drying of the deposited coating may be effected by any suitable conventional technique such as oven drying, infrared radiation drying, air drying and the like, to remove substantially all of the solvent utilized in applying the coating.

The photogeneration layer of the invention is generally of a thickness within the range of from about 0.1 micrometer to about 5.0 micrometers, preferably from about 0.3 micrometer to about 3.0 micrometers. Thicknesses outside these ranges can be selected, providing the objectives of the present invention are achieved. Higher binder content compositions generally require thicker layers for effective photogeneration. The invention is not affected by binder concentration, except that the amount of dopant will vary because the generator particle concentration is also changed.

The charge transport layer in accordance with the present invention comprises charge transport film forming polymer and charge transport molecules. The charge transport layer of some embodiments in accordance with the present invention further comprises one or more dopant comprising organic molecules containing basic electron donor or proton acceptor groups.

Suitable charge transport film forming polymers include polycarbonate resin, polyvinylcarbazole, polyester, polyarylate, polyacrylate, polyether, polysulfone, polystyrene, and the like. Preferred charge transport film forming binders are polycarbonate resins having a molecular weight from about 20,000 to about 120,000, more preferably from about 50,000 to about 100,000. The materials most preferred are poly(4,4'-dipropylidenediphenylene carbonate) with a molecular weight of from about 35,000 to about 40,000, available as Lexan 145 from General Electric Company; poly(4,4'-isopropylidenediphenylene carbonate) with a molecular weight of from about 40,000 to about 45,000, available as Lexan 141 from General Electric Company; a polycarbonate resin having a molecular weight of from about 50,000 to about 100,000, available as Makrolon from Farbenfabricken Bayer A.G.; a polycarbonate resin having a molecular weight of from about 20,000 to about 50,000, available as Merlon from Mobay Chemical Company; polyether carbonates; and 4,4'-cyclohexylidene diphenyl polycarbonate. Other polymeric combinations or mixtures thereof are not excluded.

The charge transport material is generally any suitable transparent organic polymeric or non-polymeric material capable of supporting the injection of photogenerated holes from the charge generation layer and allowing the transport of these holes through the layer to selectively discharge the surface charge.

In the inverted photoreceptor structure of FIG. 2, the photogenerated holes from the charge generation layer move to the conductive ground plane through the charge transport layer. These holes, depending on the degree of light excitation, selectively discharge electrons in the ground plane. The electrons that remain in the generator after the photogenerated holes have left, neutralize the potential from the positive charges on the surface. This causes a latent potential image to form across the photoreceptor.

In embodiments (such as that depicted in FIG. 3) in which the charge generation layer is between the charge transport layer and the substrate, the charge transport layer not only serves to transport holes, but also protects the charge generation layer from abrasion or chemical attack, and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is preferably substantially transparent to radiation in a region in which the photoconductor is to be used. When a transparent substrate is employed, imagewise exposure and/or erasure may be accomplished through the substrate. In such an embodiment, the charge transport material need not be capable of transmitting light in the wavelength region of use.

The charge transport material preferably comprises at least one aromatic amine compound of the formula:

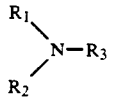

wherein $R_1$ and $R_2$ are each an aromatic group selected from the group consisting of a substituted or unsubstituted phenyl group, naphthyl group, and polyphenyl group and $R_3$ is selected from the group consisting of a substituted or unsubstituted aryl group, an alkyl group having from 1 to 18 carbon atoms and a cycloaliphatic group having from 3 to 18 carbon atoms. The substituents should be free from groups such as $NO_2$ groups, CN groups, and the like. Typical aromatic amine compounds that are represented by this structural formula include:

I. Triphenyl amines such as:

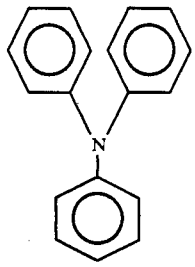

II. Bis and poly triarylamines such as:

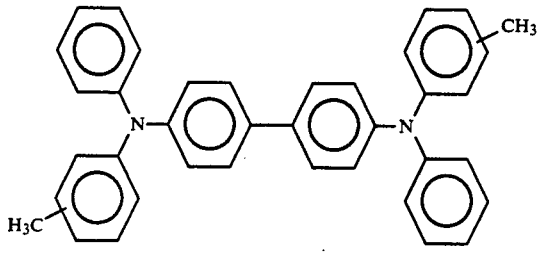

III. Bis arylamine ethers such as:

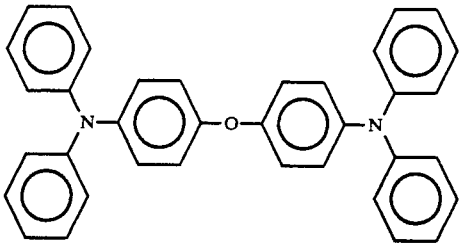

IV. Bis alkyl-arylamines such as:

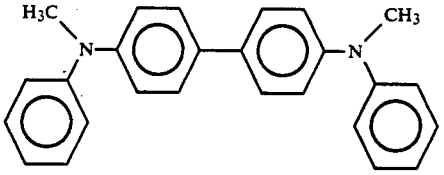

A preferred aromatic amine compound has the formula:

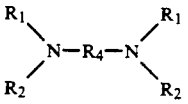

wherein $R_1$ and $R_2$ are defined above, and $R_4$ is selected from the group consisting of a substituted or unsubstituted biphenyl group, a diphenyl ether group, an alkyl group having from 1 to 18 carbon atoms, and a cycloaliphatic group having from 3 to 12 carbon atoms. The substituents should be free from groups such as $NO_2$ groups, CN groups, and the like.

Examples of charge transporting aromatic amines represented by the structural formulae above include triphenylmethane, bis(4-diethylamine-2-methylphenyl)-phenylmethane; 4-4'-bis(diethylamino)-2,2'-dimethyltriphenylmethane; N,N'-bis(alkylphenyl)-(1,1'-biphenyl)-4,4'-diamine wherein the alkyl is, for example, methyl, ethyl, propyl, n-butyl, etc.; N,N'-diphenyl-N,N'-bis(3'-methylphenyl)-(1,1'biphenyl)-4,4'-diamine; and the like, dispersed in an inactive resin binder. Other hole transport materials are not excluded.

The description of dopants which are suitable and which are preferred in connection with the charge generation layer applies as well to dopants which may be provided in the charge transport layer.

The concentration of the charge transport molecules in the charge transport layer is generally in the range of from about $3.9\times10^{20}$ to about $11.7\times10^{20}$ molecules per cubic centimeter, preferably from about $5.4\times10^{20}$ to about $9.36\times10^{20}$ molecules per cubic centimeter, most preferably from about $6.24\times10^{20}$ to about $7.8\times10^{20}$ molecules per cubic centimeter. When a dopant is provided in the charge transport layer, the concentration of dopant is generally in the range of from about 1 to about 1000 ppm by weight of coating solvent, preferably from about 1 to about 50 ppm by weight of coating solvent, more preferably from about 1 to about 25 ppm by weight of coating solvent.

The charge transport layer in some embodiments of this invention, e.g., the one shown in FIG. 3, is applied over the dried charge generation layer. In other embodiments of this invention, e.g., the one shown in FIG. 4, it is applied over the conductive layer and any blocking layer.

The charge transport layer is preferably applied by forming a charge transport coating composition by providing film forming binder in a suitable solvent, and then adding charge transport molecules. However, it is not necessary to adhere to this mixing order. For embodiments in which the charge generation layer includes one or more dopant, the dopant is preferably added to solvent prior to the addition of the film forming binder and the charge transport molecules.

Suitable solvents for use in charge transport coating compositions generally include those described above as being suitable for use in charge generation coating compositions. Generally, the combination of charge transport molecules, binder polymer and solvent should form uniform dispersions of the charge transport molecules in the charge transport coating compositions. The solvent for the charge transport film forming binder should dissolve the binder used in the charge transport layer and be capable of dissolving the charge transport molecules in the charge transport layer. When a dopant is provided in the charge transport coating composition, it should likewise dissolve in the solvent.

The concentration of charge transport molecules in the charge transport coating compositions is generally within the range of from about 25 to about 75 vol. %, preferably from about 35 to about 60 vol. %, more preferably from about 40 to about 50 vol. %. The concentration of charge transport film forming binder in the charge transport coating composition is generally within the range of from about 75 to about 25 vol. %, preferably from about 65 to about 40 vol. %, more preferably from about 60 to about 50 vol. %. The concentration of solvent in the charge transport coating composition is generally in the range of from about 1 to about 95 vol. %, preferably from about 70 to about 95 vol. %, more preferably from about 80 to about 95 vol. %.

When dopant is provided in the charge transport coating composition, the concentration of dopant is generally within the range of from about 1 to about 1000 ppm by weight, based on the weight of solvent, preferably from about 1 to about 50 ppm by weight, based on the weight of solvent, more preferably from about 1 to about 25 ppm by weight, based on the weight of solvent.

An example of a transport layer coating solution is:

Solids 50 wt. % mTBD
50 wt. % Makrolon

Solvent

Methylene chloride

Mix to form a solution of 15 wt. % solids

The dopant is added as ppm by weight of the solvent.

The above example is for Bird bar coatings and contains 15 wt. % solids. A spray coating solution would contain 5–10% solids. Therefore, the dopant level in the coating solvent would have to be adjusted to keep the ratio of dopant to solids the same.

One preferred dopant is TMG which is added as ppm by weight of the coating solution solvent.

The charge transport coating composition is applied by any suitable technique, for example, by hand, spraying, dip coating, draw bar coating, gravure coating, silk screening, air knife coating, vacuum deposition, chemical treatment, roll coating, wire wound rod coating, and the like. The charge transport coating composition is then dried to remove the solvent. Drying of the deposited coating may be effected by any suitable conventional technique such as oven drying, infrared radiation drying, air drying and the like, to remove substantially all of the solvent utilized in applying the coating.

The thickness of the charge transport layer is preferably in the range of from about 10 micrometers to about 50 micrometers, more preferably from about 20 micrometers to about 35 micrometers.

Adhesive layers may be provided, as necessary, between any of the layers in the photoreceptors in accordance with the present invention, to ensure adhesion of any adjacent layers. Alternatively or in addition, adhesive material may be incorporated into one or both of the layers to be adhered. Such optional adhesive layers preferably have thicknesses between about 0.001 micrometer and about 0.2 micrometer. Such an adhesive layer may be applied by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent.

Suitable adhesives include, for example, film-forming polymers such as polyester, du Pont 49,000 (available from E.I. du Pont de Nemours & Co.), Vitel PE-100 (available from Goodyear Rubber & Tire Co.), polyvinylbutyral, polyvinylpyrrolidone, polyurethane, polymethyl methacrylate, and the like. The invention is not affected by the adhesive layers.

An optional anti-curl layer may be provided which comprises organic polymers or inorganic polymers that are electrically insulating or slightly semi-conductive. The anti-curl layer provides flatness and/or abrasion resistance.

The anti-curl layer may be formed at the back side of the substrate, opposite to the imaging layers. The anti-curl layer may comprise a film forming resin and an adhesion promoter polyester additive. Examples of film forming resins include polyacrylate, polystyrene, poly(4,4'-isopropylidene diphenyl carbonate), 4,4'-cyclohexylidene diphenyl polycarbonate, and the like. Typical adhesion promoters used as additives include 49,000 (available from du Pont de Nemours & Co.), Vitel PE-100, Vitel PE-200, Vitel PE-307 (available from Goodyear), and the like. Usually, from about 1 to about 15 wt. % adhesion promoter is selected for film forming resin addition. The thickness of the anti-curl layer is generally within the range of from about 3 micrometers to about 35 micrometers, preferably about 14 micrometers.

An optional overcoating layer may be provided over the imaging layers which comprises organic polymers or inorganic polymers that are electrically insulating or slightly semi-conductive.

Such a protective overcoating layer preferably comprises a film forming binder doped with a charge transport compound.

Any suitable film forming inactive resin binder may be employed in the overcoating layer of the present invention. For example, the film forming binder may be any of a number of resins such as polycarbonates, polycarbazoles, polyarylates, polystyrene, polysulfone, polyphenylene sulfide, polyetherimide, and polyacrylate. The resin binder used in the overcoating layer may be the same or different from the resin binder used in the charge transport layer. The binder resins should have a Young's modulus greater than about $2\times10^5$ psi, a break elongation no less than 10 percent, and a glass transition temperature greater than 150° C. The binder may further be a blend of binders. The preferred polymeric film forming binders include Makrolon, a polycarbonate resin having a molecular weight of from about 50,000 to about 100,000 available from Farbenfabricken Bayer A.G., 4,4' cyclohexylidene diphenyl polycarbonate available from Mitsubishi Chemicals, high molecular weight Lexan 135 available from the General Electric Company, Ardel polyarylate D-100 available from Union Carbide, and polymer blends of Makrolon available from Farbenfabricken Bayer A.G. and copolyester Vitel PE-100 or Vitel PE-200, available from Goodyear Tire and Rubber Company. A range of about 1% by weight to about 10% by weight of Vitel copolyester is preferred in blended compositions, and more preferably about 3% by weight to about 7% by weight. To provide hole transporting capability through the overcoats, the above-mentioned binder resins or resin blends should be doped with at least 5% by weight charge transporting compound. Other polymers which can be used as resins in the overcoat include Durel polyarylate from Celanese, polycarbonate copolymers Lexan 3250, Lexan PPC 4501, and Lexan PPC 4701 from the General Electric Company and Calibre from Dow.

Polymeric materials which have inherent hole transporting properties such as carbazole polymers may be used as photoreceptor overcoats without the need for charge transport compound doping. These carbazoles can be used alone or in blends of film forming polymer binder and at least 30% by weight carbazole polymer. The carbazole polymers of interest are as follows:

(A)

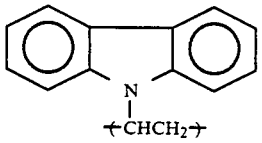

(B)

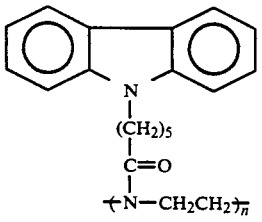

(C)

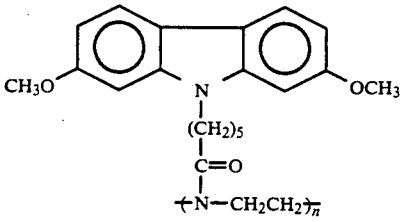

-continued (D)

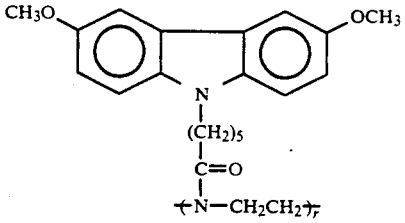

These hole transporting polymers may also be used blended with other film forming overcoat resins such as Makrolon, in the range of about 40% by weight to about 60% by weight, without the need for charge transport compound doping in the overcoat layer. For example, a 3.5 micrometers thick overcoating layer containing 60% by weight polyvinylcarbazole (structure A) and 40% by weight Makrolon provides an overcoating having adequate protection against charge transport compound leaching/crystallization and static-bend charge transport layer cracking after constant exposure to mineral oil.

The charge transport molecules used to dope the overcoating layer may be any of a number of known charge transport molecules which are employed in a charge transport layer such as those disclosed in U.S. Pat. No. 4,786,570. The charge transport molecules may be the same or different as that of the charge transport compound present in the charge transport layer. It is preferable to use the same charge transport molecules for overcoat doping as used in the charge transport layer. Charge transport molecules may include any of those mentioned above for the charge transport layer, and preferably include a compound represented as follows:

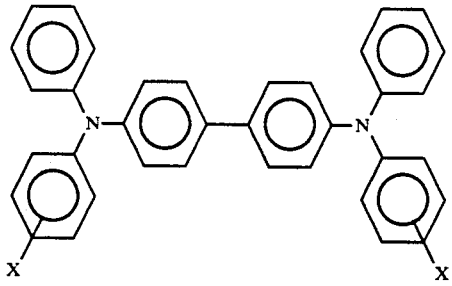

wherein X is selected from the group consisting of an alkyl group, having from 1 to about 4 carbon atoms and chlorine. Other suitable transport molecules are not excluded.

Preferably, the resin of the overcoating layer of the present invention is doped with about 3% by weight to about 10% by weight of a charge transport molecule, and more preferably, about 3% by weight to about 7% by weight. Doping with more than 10% of a charge transport molecule tends to lead to crystallization, leaching, and stress cracking. A doping of less than 3% by weight diminishes the charge transporting capability of the overcoating, and makes the photoreceptor functionally unacceptable.

The overcoating layer may be prepared by any suitable conventional technique and applied by any of a number of application methods. Typical application methods include, for example, hand coating, spray coating, web coating and the like. Drying of the deposited coating may be effected by any suitable conventional technique such as oven drying, infrared radiation drying, air drying and the like.

Overcoatings of about 3 micrometers to about 7 micrometers are effective in preventing charge transport molecule leaching, crystallization and charge transport layer cracking. Preferably, a layer having a thickness of about 3 micrometers to about 5 micrometers can be employed.

An optional ground strip may be provided adjacent the charge transport layer at an outer edge of the imaging member. See U.S. Pat. No. 4,664,995. A ground strip usually is necessary for belts but not for conducting drums and other conducting substrates. The ground strip (if employed) is coextruded with the charge transport layer so as to provide grounding contact with a grounding device (not shown) during electrophotographic processes. The ground strip comprises a film-forming polymer binder and electrically conductive particles. Cellulose may be used to disperse the conductive particles. Any suitable electrically conductive particles may be used in the electrically conductive ground strip layer. The ground strip may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness from about 7 micrometers to about 42 micrometers, preferably from about 14 micrometers to about 27 micrometers.

An especially preferred multilayer photoconductor comprises a charge generating layer comprising a binder layer of photoconductive material and a contiguous hole transport layer of a polycarbonate resin material having a molecular weight of from about 20,000 to about 120,000, having dispersed therein from about 25 to about 75 percent by weight of one or more compounds having the formula:

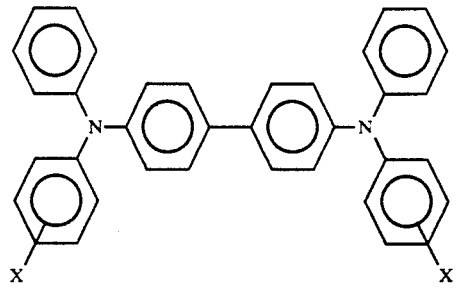

wherein X is selected from the group consisting of an alkyl group, having from 1 to about 4 carbon atoms, and chlorine, the photoconductive layer exhibiting the capability of photogeneration of holes and injection of the holes, the hole transport layer being substantially non-absorbing in the spectral region at which the photoconductive layer generates and injects photogenerated holes but being capable of supporting the injection of photogenerated holes from the photoconductive layer and transporting the holes through the hole transport layer.

In order to adjust the electrical xerographic properties of the above described photoreceptor to produce the desirable electrical characteristics that have been described previously, it is desirable to add a basic dopant to either or both the generator or transport layer. The dopant concentration will vary depending upon the impurities in the materials that are incorporated into the photoreceptor and other changes in their electrical properties brought about by the usual fluctuations in manufacturing processes. The amount of solvent used to form the proper coating solution will vary depending on the method of making the layers of the photoreceptor, i.e., roll coating versus spray and dip coating. Typically spray coating requires more solvent than roll coating. Dip coating requires about the same amount of solvent as roll coating. The range of dopant should lie within 1 to 1000 ppm by weight of the solvent added to the solids to produce the proper coating solution.

The invention will further be illustrated in the following non-limiting examples, it being understood that these examples are intended to be illustrative only and that the invention is not intended to be limited to the materials, conditions, process parameters and the like recited herein.

EXAMPLE

A mylar substrate was coated with titanium and then with a layer of silane. Next, an adhesive layer was applied to the silane layer.

The preferred combinations of materials to form the photoreceptor are a titanium ground plane with approximately 20% transmission on mylar coated with a silane blocking layer of approximately 500 Å in thickness. The 3-aminopropyltriethoxysilane used to make the coating is hydrolyzed and the neutralized with acetic acid. The silane is coated with an approximately 700 Å layer of 49K interface. A generator layer of 7.5 vol. % trigonal selenium pigment, 67.5 vol. % PVK binder and 25 vol. % mTBD transport molecule is coated on the interface to a thickness of approximately 2.3μ. A 25μ transport layer containing 50 wt. % mTBD and 50 wt. % polycarbonate binder is then added as the last layer. The dopant is added to the transport layer coating solution in the manner described previously usually in the range of 10–50 ppm.

Next, a charge generation slurry is formed by mixing 7.5 vol. % trigonal selenium pigment, 25 vol. % N-N'-diphenyl-N,N'-bis[3-methylpropyl]-[1,1'-biphenyl]-4,4'-diamene and 67.5 vol. % PVK solids, and the slurry is added to a solvent containing equal quantities by volume of THF and toluene to form a charge generation coating composition of 6 vol. % solids. The charge generation coating composition is applied to the adhesive layer using a Bird bar coater and is dried by air drying for 5 to 10 minutes at ambient temperature, followed by subjecting to forced air at 135° C. for 5 minutes. Next, a transport layer coating composition is formed by mixing equal amounts by weight of N-N'-diphenyl-N,N'-bis[3-methyl-propyl]-[1,1'-biphenyl]-4,4'-diamine and Makrolon solids, which are then added to methylene chloride solvent to form a solution of 15 wt. % solids. The transport layer coating composition is then applied to the dried charge generation layer using a Bird bar coater and dried in the same manner as the charge generation layer is dried.

The above procedure is then repeated, except that dopant is added to the charge generation coating compositions in the amounts (in parts per million based on the weight of THF-toluene solvent) shown in Table 1:

TABLE 1

| Charge Generation Coating Composition | Dopant | Doping (in ppm by weight) |
|---|---|---|
| 57-1A | TMG | 0 |
| 57-2A | TMG | 25 |
| 57-3A | TMG | 50 |
| 57-4A | TMG | 100 |
| 57-5A | TMG | 200 |
| 54-1A | HA | 0 |
| 54-2A | HA | 223 |
| 54-3A | HA | 446 |
| 54-4A | HA | 892 |
| 54-5A | HA | 1784 |

It is found that the incorporation of dopant in accordance with the present invention improve the cyclic stability at a relative humidity of 40%. It is also observed that the $V_{ddp}$ stability is improved and that the fatigued dark decay is decreased. To reduce $V_{bg}$, but yet maintain even cyclic stability using TMG dopant, an optimum amount of dopant is less than 25 ppm. To reduce the $V_{bg}$ and the $V_R$ cycle up using NHA dopant, an optimum amount of dopant is less than 223 ppm.

TABLE 2

Table of doping results for trigonal selenium without sodium

| Sample | Dopant | Dopant Level | $\Delta V_{ddp}$ in 10K | Initial $V_{ddp}$ | Initial $V_{bg}$ |
|---|---|---|---|---|---|
| 57-1A | | 0.0 ppm | −68 | 601 | 95 |
| 57-2A | TMG | 25.0 | +2 | 683 | 186 |
| 54-1A | | 0.0 ppm | −100 | 598 | 89 |
| 54-2A | HA | 223.0 | −3 | 713 | 206 |

Table 2 shows how the base doping has increased the cycle stability of these photoreceptor's that are made with no sodium doping of the pigment. The $\Delta V_{ddp}$ which is the drop in the $V_{ddp}$ over 10K cycles has been decreased substantially. The base doping has increased both the initial $V_{ddp}$ and $V_{bg}$. These photoreceptor's with undoped pigment and without base doping would have been considered to have too low a $V_{ddp}$ and $V_{bg}$ to be useful replacement for a photoreceptor with sodium doped trigonal selenium pigment. The base doping has increased these values to be similar to those for a photoreceptor with sodium doped pigment.

Another example of the beneficial effect of base doping a photoreceptor with undoped trigonal selenium pigment is the reduction of white spots in the prints over that which would appear if a sodium doped pigment had been used in the photoreceptor. The photoreceptors in this example are made with a roll coater. The generator in this example is formed in the same way as described above except equal volumes of THF and toluene to provide a coating slurry of 8 vol. %. The TMG dopant is added to the solvent in ppm by weight of the solvent. The table below shows how the TMG doping in the generator in the absence of sodium decreases the spot density as the TMG level increased. It also shows how the TMG doping decreases the growth in spot size density with cycling over that of Standard AMAT with Na in Se.

TABLE 3

| Photoreceptor Sample* | Descript. | TMG ppm | Spots/ in$^2$(t=0) | Spots/ in$^2$(t=1 hr) |
|---|---|---|---|---|
| 3692-3294 | No NA 24 μ SMTL | 0 | 130 | 323 |
| -2082 | - | 1 | 137 | 287 |
| -1515 | - | 5 | 61 | 148 |
| -351 | | 25 | 33 | 45 |
| -2427 | - | 1 | 184 | 453 |
| -1182 | - | 5 | 118 | 180 |
| -591 | - | 25 | 46 | 48 |
| 3701-2187 | Standard AMAT with Na in Se | 0 | 51 | 164 |
| Average over a group St. | | 0 | 63 ± 16 | 185 ± 78 |

AMAT with Na in Se ± one standard deviation

Although the invention has been described with reference to specific preferred embodiments, it is not limited thereto; rather, those skilled in the art will recognize that variations and modifications can be made which are within the spirit of the invention and within the scope of the claims.

What is claimed is:

1. A process for preparing a photoreceptor, comprising:

providing a conductive layer;

applying a charge generation layer over said conductive layer, said charge generation layer comprising charge generation binder and photogeneration particles, wherein all said photogenerating particles are selected from the group consisting of amides of perylene, amides of perinone, benzimidazole perylene, dibromoanthanthrone, chalcogens of tellurium III-V compounds and selenium pigments; and applying a charge transport layer over said charge generation layer, said charge transport layer comprising charge transport binder and charge transport molecules;

at least one of said charge generation layer and said charge transport layer further including dopant selected from the group consisting of aliphatic amines and aromatic amines, with the proviso that when said dopant is in said charge transport layer, said dopant comprises aliphatic amine.

2. The process of claim 1, wherein said dopant is selected from the group consisting of triethanolamine, n-dodecylamine, n-hexadecylamine, tetramethyl guanidine, 3-aminopropyltriethoxy silane, 3-aminopropyltrihydroxysilane and its oligomers.

3. The process of claim 1, wherein said charge generation layer comprises said dopant.

4. The process recited in claim 1, wherein said charge transport layer comprises said dopant.

5. The process of claim 1, wherein both said charge generation layer and said charge transport layer comprise said dopant.

6. The process for preparing a photoreceptor, comprising:

providing a conductive layer;

applying a charge transport layer over said conductive layer, said charge transport layer comprising charge transport binder and charge transport molecules; and applying a charge generation layer over said charge transport layer, said charge generation layer comprising charge generation binder and photogenerating particles, wherein all said photogenerating particles are selected from the group consisting of amides of perylene, amides of perinone, benzimidazole perylene, dibromoanthanthrone, chalcogens of tellurium III-V compounds and selenium pigments;

at least one of said charge transport layer and said charge generation layer further comprising at least one dopant comprising organic molecules containing basic electron donor or proton acceptor groups.

7. The process of claim 6, wherein said charge transport layer comprises said dopant.

8. The process of claim 6, wherein said charge generation layer comprises said dopant.

9. The process of claim 6, wherein both said charge generation layer and said charge transport layer comprise said dopant.

10. The process of claim 6, wherein said dopant is selected from the group consisting of aliphatic amines and aromatic amines.

11. The process of claim 6, wherein said dopant is selected from the group consisting of triethanolamine, n-dodecylamine, n-hexadecylamine, tetramethyl guanidine, 3-aminopropyltriethoxy silane, 3-aminopropyltrihydroxysilane and its oligomers.

12. A photoreceptor comprising a charge transport layer which is comprised of binder, charge transport molecules, and at least one dopant selected from the group consisting of aliphatic amines.

13. A photoreceptor as recited in claim 12, wherein said dopant is selected from the group consisting of triethanolamine, n-dodecylamine, n-hexadecylamine, tetramethyl guanidine, 3-aminopropyltriethoxy silane, 3-aminopropyltrihydroxysilane and its oligomers.

14. A photoreceptor comprising a charge generation layer which is comprised of binder, photogenerating particles, wherein all said photogenerating particles are selected from the group consisting of amides of perylene, amides of perinone, benzimidazole perylene, dibromoanthanthrone, chalcogens of tellurium III-V compounds and selenium pigments, and at least one dopant selected from the group consisting of aliphatic amines and aromatic amines.

15. A photoreceptor as recited in claim 14, wherein said dopant is selected from the group consisting of triethanolamine, n-dodecylamine, n-hexadecylamine, tetramethyl guanidine, 3-aminopropyltriethoxy silane, 3-aminopropyltrihydroxysilane and its oligomers.

16. A photoreceptor comprising:

a conductive layer;

a charge generation layer comprising charge generation binder and photogenerating particles, wherein all said photogenerating particles are selected from the group consisting of amides of perylene, amides of perinone, benzimidazole perylene, dibromoanthanthrone, chalcogens of tellurium III-V compounds and selenium pigments, said charge generation layer being positioned over said conductive layer; and a charge transport layer comprising charge transport binder and charge transport molecules, said charge transport layer being positioned over said charge generation layer;

at least one of said charge generation layer and said charge transport layer comprising at least one dopant comprising at least one compound selected from the group consisting of aliphatic amines and aromatic amines, with the proviso that when said dopant is in said charge transport layer, said dopant comprises aliphatic amine.

17. A photoreceptor as recited in claim 16, wherein said dopant is selected from the group consisting of triethanolamine, n-dodecylamine, n-hexadecylamine, tetramethyl guanidine, 3-aminopropyltriethoxy silane, 3-aminopropyltrihydroxysilane and its oligomers.

18. A photoreceptor as recited in claim 16, wherein said charge generation layer comprises said dopant.

19. A photoreceptor as recited in claim 16, wherein said charge transport layer comprises said dopant.

20. A photoreceptor as recited in claim 16, wherein both said charge generation layer and said charge transport layer comprise said dopant.

21. A photoreceptor as recited in claim 18, wherein said dopant comprises from about 1 to about 1000 ppm by weight, based on the weight of solvent added to the charge generator coating solution.

22. A photoreceptor as recited in claim 21, wherein said dopant comprises from about 1 to about 50 ppm by weight, based on the weight of solvent added to the charge generator coating solution.

23. A photoreceptor comprising:

a conductive layer;

a charge transport layer comprising charge transport binder and charge transport molecules, said charge transport layer being positioned over said conductive layer; and a charge generation layer comprising charge generation binder and photogenerating particles, wherein all said photogenerating particles are selected from the group consisting of amides of perylene, amides of perinone, benzimidazole perylene, dibromoanthanthrone, chalcogens of tellurium III-V compounds and selenium pigments, said charge generation layer being positioned over said charge transport layer;

at least one of said charge generation layer and charge transport layer comprising at least one dopant comprising organic molecules containing basic electron donor or proton acceptor groups.

24. A photoreceptor as recited in claim 23, wherein said dopant is selected from the group consisting of aliphatic and aromatic amines.

25. A photoreceptor as recited in claim 23, wherein said dopant is selected from the group consisting of triethanolamine, n-dodecylamine, n-hexadecylamine, tetramethyl guanidine, 3-aminopropyltriethoxy silane, 3-aminopropyltrihydroxysilane and its oligomers.

26. A photoreceptor as recited in claim 23, wherein said charge transport layer comprises said dopant.

27. A photoreceptor as recited in claim 26, wherein said dopant comprises from about 1 to about 1000 ppm by weight based on the weight of the solvent added to the charge transport layer.

28. A photoreceptor as recited in claim 23, wherein said charge generation layer comprises said dopant.

29. A photoreceptor as recited in claim 23, wherein both said charge generation layer and said charge transport layer comprise said dopant.

30. A photoreceptor as recited in claim 29, wherein said dopant comprises from about 1 to about 50 ppm by weight, based on the weight of the solvent added to the charge generator layer.

31. A photoreceptor comprising:

a conductive layer;

a charge generation layer comprising charge generation binder and photogenerating particles, wherein said photogenerating particles are selected from the group consisting of metal-free phthalocyanine and metal phthalocyanines, said charge generation layer being positioned over said conductive layer; and a charge transport layer comprising charge transport binder and charge transport molecules, said charge transport layer being positioned over said charge generation layer; and at least one of said charge generation layer and said charge transport layer comprising tetramethyl guanidine.

32. A process of claim 1, wherein said selenium pigment comprises chalcogens of selenium II–VI, amorphous selenium, trigonal selenium, or selenium alloys.

33. A process of claim 6, wherein said selenium pigment comprises chalcogens of selenium II–VI, amorphous selenium, trigonal selenium or selenium alloys.

34. A photoreceptor as recited in claim 14, wherein said selenium pigment comprises chalcogens of selenium II–VI, amorphous selenium, trigonal selenium or selenium alloys.

35. A photoreceptor as recited in claim 16, wherein said selenium pigment comprises chalcogens of selenium II–VI, amorphous selenium, trigonal selenium or selenium alloys.

36. A photoreceptor as recited in claim 23, wherein said selenium pigment comprises chalcogens of selenium II–VI, amorphous selenium, trigonal selenium or selenium alloys.

37. The photoreceptor of claim 31, wherein the metal-free phthalocyanine comprises X-form metal-free phthalocyanine.

38. The photoreceptor of claim 31, wherein the metal phthalocyanine comprises vanadyl phthalocyanine, copper phthalocyanine or titanyl phthalocyanine.

* * * * *